US005908516A

United States Patent [19]

Nguyen-Dinh

[11] Patent Number: 5,908,516

[45] Date of Patent: Jun. 1, 1999

[54] TITANIUM ALUMINIDE ALLOYS CONTAINING BORON, CHROMIUM, SILICON AND TUNGSTEN

[76] Inventor: Xuan Nguyen-Dinh, 3083 NW. Ashford Cir., Hillsboro, Oreg. 97124

[21] Appl. No.: 08/920,316

[22] Filed: Aug. 27, 1997

Related U.S. Application Data

[60] Provisional application No. 60/024,856, Aug. 28, 1996.

[51] Int. Cl.[6] ..... C22C 14/00

[52] U.S. Cl. ..... 148/421; 420/418; 148/669

[58] Field of Search ..... 148/421, 669, 148/670, 671; 420/418

[56] References Cited

U.S. PATENT DOCUMENTS

| | | | |
|---|---|---|---|
| 3,203,794 | 8/1965 | Jaffee et al. . | |
| 4,294,615 | 10/1981 | Blackburn et al. . | |
| 4,836,983 | 6/1989 | Huang et al. . | |
| 4,842,219 | 6/1989 | Huang | 420/418 |
| 4,842,817 | 6/1989 | Huang et al. . | |
| 4,842,819 | 6/1989 | Huang et al. . | |
| 4,842,820 | 6/1989 | Huang et al. | 420/418 |
| 4,849,168 | 7/1989 | Nishlyama et al. . | |
| 4,857,268 | 8/1989 | Huang et al. . | |
| 4,879,092 | 11/1989 | Huang . | |
| 4,923,534 | 5/1990 | Huang et al. . | |
| 5,028,491 | 7/1991 | Huang | 428/614 |
| 5,045,406 | 9/1991 | Huang . | |
| 5,076,858 | 12/1991 | Huang . | |
| 5,080,860 | 1/1992 | Huang | 420/418 |
| 5,082,506 | 1/1992 | Huang . | |
| 5,082,624 | 1/1992 | Huang . | |
| 5,098,653 | 3/1992 | Huang | 420/418 |

(List continued on next page.)

FOREIGN PATENT DOCUMENTS

| | | |
|---|---|---|
| 0275391 | 7/1988 | European Pat. Off. . |
| 0349734 | 1/1990 | European Pat. Off. . |
| 0363598 | 4/1990 | European Pat. Off. . |
| 0368642 | 5/1990 | European Pat. Off. . |
| 0405134 | 1/1991 | European Pat. Off. . |
| 1-298127 | 1/1989 | Japan . |
| 1-255632 | 10/1989 | Japan . |
| 2-78734 | 3/1990 | Japan . |
| 2-157403 | 6/1990 | Japan . |
| 2-160187 | 6/1990 | Japan . |
| 2-160188 | 6/1990 | Japan . |

OTHER PUBLICATIONS

J. Busch, "Cost Modeling as a Technical Management Tool", *Research–Technology Management* (Nov.–Dec. 1994), pp. 50–56.

(List continued on next page.)

*Primary Examiner*—John Sheehan
*Attorney, Agent, or Firm*—Blodgett & Blodgett, P.C.

[57] ABSTRACT

This invention is a Titanium Aluminum alloy consisting essentially of the formula in atomic percent; $Ti_{Bal.}$ $Al_{45-48}$ $B_{0.01-0.75}$ $Cr_{0-2}$ $W_{0.25-2.25}$ $Si_{0.1-0.7}$. The Boron is present in an atom. % of 0.01–0.75. The desired range is 0.1–0.5. The preferred range is 0.25+/–0.05. The optimum range is 0.25. The Chromium is present in an atom. % of 0–2. The desired range is 1.3–1.6. The preferred range is 1.5+/–0.1. The optimum range is 1.5. The Tungsten is present in an atom. % of 0.25–2.25. The desired range is 0.3–2.11. The preferred range is 0.75+/–0.05. The optimum range is 0.75. The Silicon is present in an atom. % of 0.1–0.7. The desired range is 0.4–0.6. The preferred range is 0.5+/–0.05. The optimum range is 0.5. The atom. % ratio of Cr/W is 0–5. The desired range is 1.33–2.69. The preferred range is 1.8–2.6. The optimum range is 1.85–2.5. The preferred alloy is a Titanium Aluminum alloy consisting essentially of the formula in atomic percent; $Ti_{Bal.}$ $Al_{45.82}$ $B_{0.25}$ $Cr_{1.42}$ $W_{0.70}$ $Si_{0.45}$. The invention is also an article and method of forming said article of the above descibed alloy, for use as an engine component in high temperature and high stress situations. The process for forming the product includes investment casting and then thermomechanical treatment and/or homogenization.

20 Claims, 21 Drawing Sheets

AVERAGE VALUES OF ROOM TEMPERATURE TENSILE PROPERTIES OF VARIOUS ALLOYS INVESTIGATED

| Alloy | Ti | Al | V | C | | | | YS (ksi) | UTS (ksi) | % El. |
|---|---|---|---|---|---|---|---|---|---|---|
| 11 | Bal. | 49.00 | 1.0 | 0.15 | | | | 44.55 | 54.87 | 1.00 |
| Alloy | Ti | Al | Cr | W | Si | B | Cr/W | YS (ksi) | UTS (ksi) | % El. |
| 2 | Bal. | 46.36 | | 2.01 | 0.60 | | 0 | 0.00 | 75.45 | 0.44 |
| 1 | Bal. | 46.43 | | 2.11 | 0.67 | 0.26 | 0 | 83.10 | 88.15 | 0.67 |
| 3 | Bal. | 46.90 | | 2.08 | 0.51 | 0.45 | 0 | 89.50 | 99.65 | 0.83 |
| 4 | Bal. | 46.77 | 1.34 | 1.01 | 0.17 | | 1.33 | 70.60 | 80.30 | 0.92 |
| 5 | Bal. | 46.53 | 1.45 | 0.54 | 0.43 | | 2.68 | 74.40 | 85.10 | 0.89 |
| 6 | Bal. | 46.74 | 1.52 | 0.30 | 0.44 | | 5.07 | 71.70 | 75.30 | 0.62 |
| 7 | Bal. | 46.16 | 1.26 | 0.82 | 0.43 | | 1.54 | 72.00 | 75.80 | 0.60 |
| 8 | Bal. | 46.24 | 1.37 | 0.75 | 0.42 | | 1.82 | 71.80 | 76.30 | 0.70 |
| 12 | Bal. | 45.82 | 1.42 | 0.70 | 0.45 | 0.25 | 2.01 | 80.40 | 92.60 | 1.10 |

U.S. PATENT DOCUMENTS

| | | | |
|---|---|---|---|
| 5,111,570 | 5/1992 | Baumgarten et al. . | |
| 5,131,959 | 7/1992 | Huang . | |
| 5,149,497 | 9/1992 | McKee et al. | 420/418 |
| 5,204,058 | 4/1993 | Huang | 420/418 |
| 5,205,875 | 4/1993 | Huang . | |
| 5,207,982 | 5/1993 | Nazmy et al. | 420/418 |
| 5,228,931 | 7/1993 | Huang | 148/421 |
| 5,262,123 | 11/1993 | Thomas et al. . | |
| 5,264,051 | 11/1993 | Huang | 420/421 |
| 5,264,054 | 11/1993 | Huang . | |
| 5,286,443 | 2/1994 | Nazmy et al. . | |
| 5,304,344 | 4/1994 | Huang | 420/418 |
| 5,324,367 | 6/1994 | Huang . | |
| 5,342,577 | 8/1994 | Nazmy et al. . | |
| 5,431,752 | 7/1995 | Brogle et al. . | |

OTHER PUBLICATIONS

C. Mercer and W.O. Soboyejo, "Effects of Alloying on Crack–Tip Deformation and shielding in Gamma–Based Titanium Aluminides", International Symposium on Gamma Titanium Aluminides, TMS Annual Meeting, Las Vegas, Feb. 13–16, 1995.

W.O. Soboyejo et al., "Mechanisms of Fatigue Crack Growth in Ti–48A1 at Ambient and Elevated Temperature", *Scripta Metallurgica et Materialia*, vol. 33, No. 7, pp. 1169–1176 (1995).

C. Mercer and W.O. Soboyejo, "Effects of Alloying on Crack–Tip Deformation and Shielding in Gamma–Based Titanium Aluminides", *Fatigue and Fracture of Ordered Intermetallic Materials: II*, Ed. W.O. Soboyejo et al., The Minerals, Metals & Materials Society, 1995, pp. 17–29.

W.O. Soboyejo et al., "An Investigation of the Fatigue and Fracture Behavior of Mn–Containing Gamma Titanium Alumindes", *Metallurgical and Materials Transactions A*, vol. 26A, Sep. 1995, pp. 2275–2291.

C. Mercer and W.O. Soboyejo, "Hall–Petch Relationships in Gamma Titanium Aluminides", *Scripta Materialia*, vol. 35, No. 1, pp. 17–22, (1996).

C. Mercer and W.O. Soboyejo, "Effects of Alloying on Crack–Tip Deformation and Shielding in Gamma–Based Titanium Aluminides", *Acta Mater.*, vol. 45, No. 3, pp. 961–971, (1997).

N.S. Stoloff, "Ordered Alloys–Physical Metallurgy and Structural Applications", *International Metal Reviews*, vol. 29, No. 3 (1984), pp. 123–135.

Whang et al., "Effect of Rapid Solidification in $LI_0$ TiA1 Compound Alloys", ASM Symposium Proceedings on Enhanced Properties in Structural Metals Via Rapid Solidification, Materials Week, '86 Oct. 6–9, 1986, Orlando, Fl., pp. 1–7.

G. Sauthoff, "Intermetallische Phasen", *Magazin Neue Werkstoffe*, 1' 89, pp. 15–19.

Y.–W. Kim, "Intermetallic Alloys Based on Gamma Titanium Aluminide", *JOM*, (Jul. 1989), pp. 24–30.

Wunderlich et al., "Enhanced Plasticity by Deformation Twinning of Ti–Al–Based Alloys with Cr and Si", *Z. Metallkde.*, Bd. 81 (1990) H. 11, pp. 802–808, Nov. 1990.

Nishiyama et al., "Development of Titanium Aluminide Turbocharger Rotor", International Gas Turbine Congress Paper, Tokyo, (1987) pp. III–263–270.

Nishiyama et al., "Development of Titanium Aluminide Turbocharger Rotors", *High Temperature Aluminides and Intermetallics*, ed.Whang et al., The Minerals, Metals & Materials Society, 1990, pp. 557, 574–577.

Chan, K.S., "Understanding Fracture Toughness in Gamma TiAl", *JOM*, May 1992, pp. 30–38.

Froes et al., "Review: Synthesis, Properties and Applications of Titanium Aluminides", *Journal of Materials Science*, 27 (1992) 5113–5140.

W.O. Soboyejo and C. Mercer, "The Effects of Alloying and Microstructure on the Fracture of Intermetallic Compounds Based on TiAl", ed. Soboyejo et al., *Fatique and Fracture of Ordered Intermetallic Materials: I*, The Minerals, Metals & Materials Society, 1994.

Y.–W. Kim, "Ordered Intermetallic Alloys, Part III: Gamma Titanium Aluminides", *JOM*, Jul. 1994, pp. 30–39.

| Shrink factors determined by dimensional measurements<br>Average values (standard deviation) | | | |
|---|---|---|---|
| | Type A | Type B | Overall |
| Shrink factor for: | | | |
| Wax to metal | 1.018 (0.006) | 1.014 (0.005) | 1.016 (0.006) |
| Tool to metal | 1.046 (0.006) | 1.035 (0.006) | 1.041 (0.008) |

FIG. 2 Locations of measurements made to determine the shrink factor

FIG. 3 Selected target copositions (in atomic %) for alloy modification

| Alloy | Ti | Al | Cr | W | Si | B | Comments |
|---|---|---|---|---|---|---|---|
| 1 | bal. | 48 | --- | 2.0 | 0.5 | 0.2 | Grain refinement |
| 2 | bal. | 48 | --- | 2.0 | 0.5 | -- | Baseline |
| 3 | bal. | 48 | --- | 2.0 | 0.5 | 0.5 | Grain refinement |
| 4 | bal. | 48 | 1.5 | 1.0 | 0.5 | -- | Improved ductility |
| 5 | bal. | 48 | 1.5 | 0.5 | 0.5 | -- | Improved ductility |
| 6 | bal. | 48 | 0.2 | 0.2 | 0.5 | -- | Improved ductility |

FIG. 4 Results of the chemical analyses of Phase I alloys

| Alloy | | Ti | Al | Cr | W | Si | B |
|---|---|---|---|---|---|---|---|
| 1 | Analyzed wt. % | Bal. | 30.69 | | 9.50 | 0.46 | 0.07 |
| | Actual atom. % | Bal. | 46.43 | | 2.11 | 0.67 | 0.26 |
| | Target atom. % | Bal. | 47.45 | | 2.00 | 0.50 | 0.25 |
| 2 | Analyzed wt. % | Bal. | 30.64 | | 9.07 | 0.41 | |
| | Actual atom. % | Bal. | 46.36 | | 2.01 | 0.60 | |
| | Target atom. % | Bal. | 47.45 | | 2.00 | 0.50 | |
| 3 | Analyzed wt. % | Bal. | 31.13 | | 9.40 | 0.35 | 0.12 |
| | Actual atom. % | Bal. | 46.90 | | 2.08 | 0.51 | 0.45 |
| | Target atom. % | Bal. | 47.45 | | 2.00 | 0.50 | 0.50 |
| 4 | Analyzed wt. % | Bal. | 31.94 | 1.76 | 4.69 | 0.12 | |
| | Actual atom. % | Bal. | 46.77 | 1.34 | 1.01 | 0.17 | |
| | Target atom. % | Bal. | 47.45 | 1.50 | 1.00 | 0.50 | |
| 5 | Analyzed wt. % | Bal. | 32.29 | 1.94 | 2.56 | 0.31 | |
| | Actual atom. % | Bal. | 46.53 | 1.45 | 0.54 | 0.43 | |
| | Target atom. % | Bal. | 47.45 | 1.50 | 0.50 | 0.50 | |
| 6 | Analyzed wt. % | Bal. | 32.75 | 2.05 | 1.43 | 0.32 | |
| | Actual atom. % | Bal. | 46.74 | 1.52 | 0.30 | 0.44 | |
| | Target atom. % | Bal. | 47.45 | 1.50 | 0.20 | 0.50 | |

FIG. 5
Comparison of predicted AI content (wt. %) and actual AI (wt. %) in casting.

| Alloy | AI (Ingot) | Predicted | AI (casting) | Delta (AI) |
|---|---|---|---|---|
| 1 & 2 | 31.18 | 30.66 | 30.69 | -0.03 |
| 3 | 31.73 | 31.16 | 31.13 | 0.03 |
| 4 | 32.54 | 31.89 | 31.94 | -0.05 |
| 5 | 33.08 | 32.37 | 32.29 | 0.08 |
| 6 | 33.42 | 32.68 | 32.75 | -0.07 |

FIG. 6 Required addition to target AI (wt %) content

| Alloy | AI (casting) | AI (ingot) | Delta (AI) |
|---|---|---|---|
| 1 & 2 | 31.18 | 31.76 | 0.58 |
| 3 | 31.73 | 32.37 | 0.64 |
| 4 | 32.54 | 33.27 | 0.73 |
| 5 | 33.08 | 33.87 | 0.79 |
| 6 | 33.42 | 34.24 | 0.82 |

Correlation between aim Al content (ingot) and actual Al content (casting).

FIG. 8 Results of grain size measurements

| Alloy | As-Cast | | HIP | | HIP + HT |
|---|---|---|---|---|---|
| | Average (μm) | St. deviation (μm) | Average (μm) | St. deviation (μm) | Average (μm) |
| 1 | 63.0 | 4.5 | 86.0 | 6.0 | 159.1 |
| 2 | 80.5 | 7.8 | 112.5 | 1.1 | 170.2 |
| 3 | 62.5 | 5.1 | 84.3 | 7.5 | 124.3 |
| 4 | 65.1 | 4.1 | 99.5 | 9.0 | 226.9 |
| 5 | 71.5 | 6.5 | 93.8 | 8.5 | 202.0 |
| 6 | 88.6 | 5.3 | 123.2 | 16.0 | 224.1 |

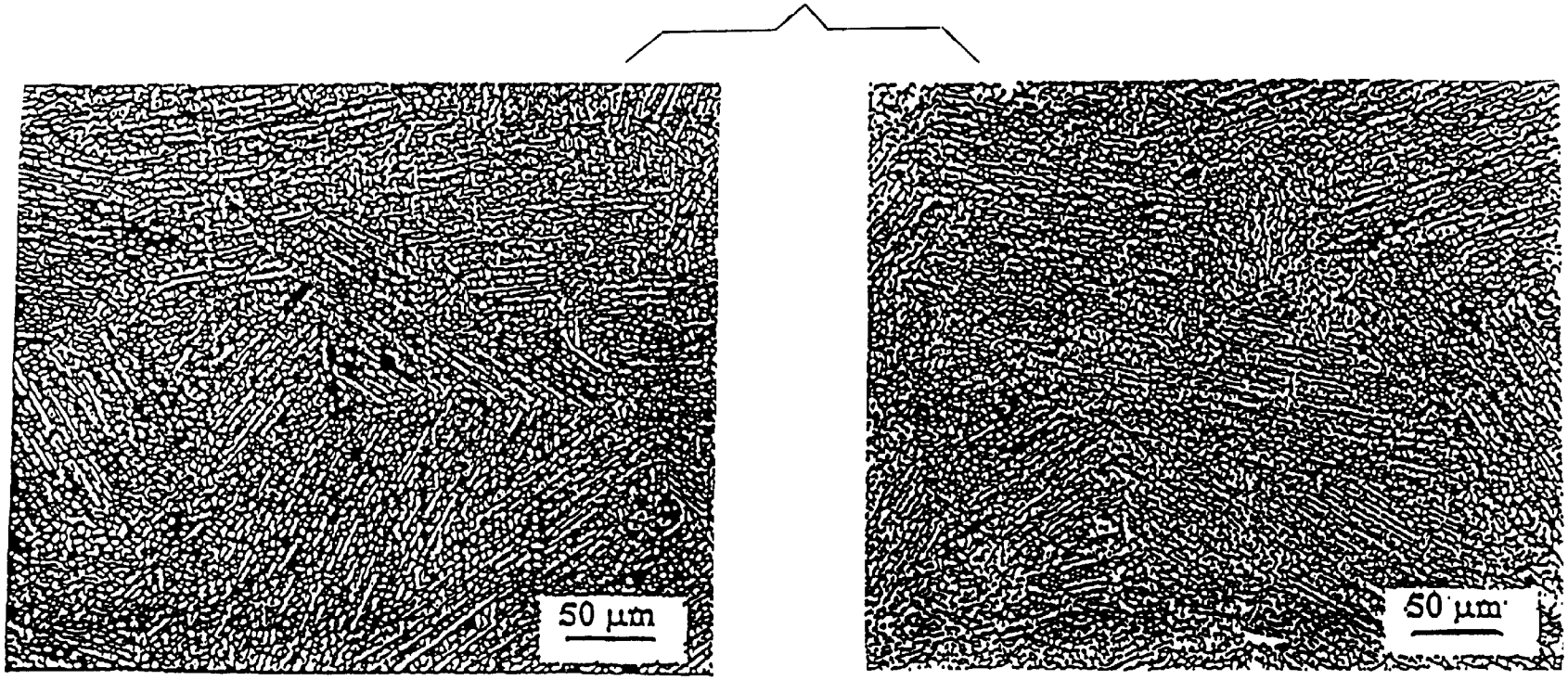
FIG. 9 Typical Microstructures of Alloy 2 in the as-cast and as-HIP conditions FIG. 10 Room temperature tensile test results of HIP specimens

| Alloy ID | Yield (ksi) | UTS (ksi) | Plastic strain (%) | Total elong. (%) |
|---|---|---|---|---|
| 1 | 86.6 | 96.1 | 0.44 | 0.85 |
| | 79.6 | 80.2 | 0.21 | 0.48 |
| 2 | ----(*) | 75.9 | 0.18 | 0.46 |
| | ----(*) | 75.0 | 0.19 | 0.42 |
| 3 | 90.0 | 103.6 | 0.60 | 0.93 |
| | 89.0 | 95.7 | 0.39 | 0.73 |
| 4 | 70.6 | 80.3 | 0.54 | 0.92 |
| 5 | 73.1 | 80.0 | 0.39 | 0.74 |
| | 75.7 | 90.2 | 0.85 | 1.03 |
| 6 | 71.7 | 75.3 | 0.32 | 0.62 |

(*) denotes fracture before yielding.

FIG. 11

Room temperature tensile test results of HIP + HT specimens

| Alloy ID | Yield (ksi) | UTS (ksi) | Plastic strain (%) | Total elong. (%) |
|---|---|---|---|---|
| 1 | ----(*) | 74.8 | 0.11 | 0.31 |
| 2 | ----(*) | 63.6 | 0.02 | 0.23 |
| 3 | ----(*) | 97.9 | 0.11 | 0.39 |
| 4 | 71.4 | 77.9 | 0.35 | 0.65 |
| 5 | 73.1 | 78.6 | 0.33 | 0.65 |
| 6 | 67.6 | 78.5 | 0.66 | 0.90 |

(*) denotes fracture before yielding

FIG. 12 1200°F tensile test results of HIP + HT specimens

| Alloy ID | Yield (ksi) | UTS (ksi) | Plastic strain (%) | Total elong. (%) |
|---|---|---|---|---|
| 1 | 80.0 | 91.9 | 1.0 | 2.83 |
| 2 | 79.6 | 102.3 | 1.8 | 4.91 |
| 3 | 72.3 | 88.3 | 1.5 | 4.88 |
| | 81.0 | 96.0 | 1.6 | 3.56 |
| | 74.5 | 93.7 | 1.1 | 2.95 |
| 4 | 63.7 | 83.1 | 2.0 | 3.80 |
| 5 | 61.5 | 86.0 | 2.1 | 3.89 |
| 6 | 54.5 | 79.9 | 2.6 | 4.04 |

FIG. 13 Assumptions used in Figure 14

| PROCESS | REJECTION RATE (%) |
|---|---|
| Wax molding | 0.1 |
| Visual inspection | 20.0 |
| X-ray radiography | 2.0 |
| Zyglo inspection | 2.0 |
| Dimensional inspection | 2.0 |
| Finishing | 2.0 |

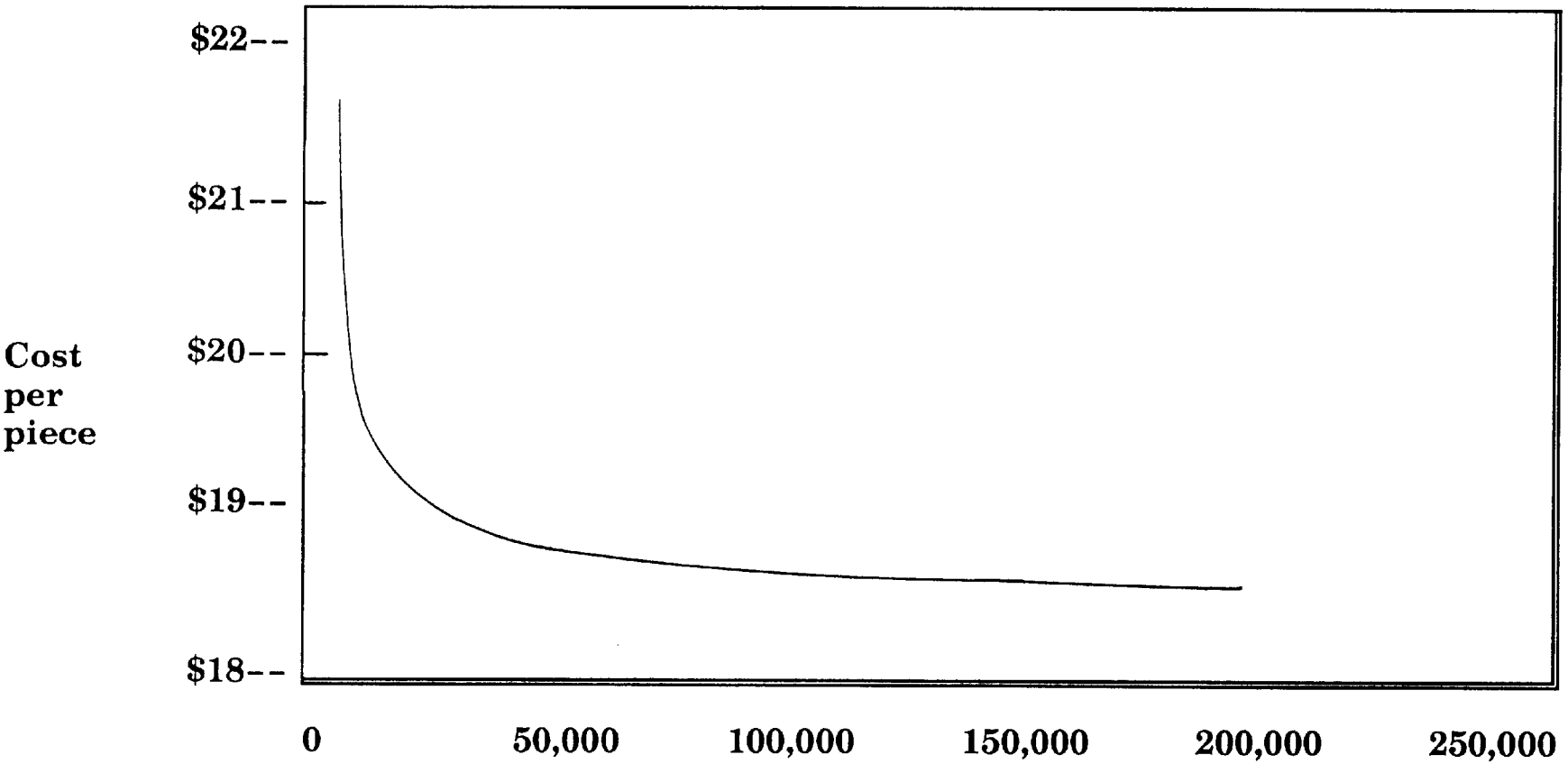
FIG. 14 Effect of annual production volume on cost per piece

FIG. 15

AVERAGE VALUES OF ROOM TEMPERATURE TENSILE PROPERTIES OF VARIOUS ALLOYS INVESTIGATED

| Alloy | Ti | Al | V | C | | | | YS (ksi) | UTS (ksi) | % El. |
|---|---|---|---|---|---|---|---|---|---|---|
| 11 | Bal. | 49.00 | 1.0 | 0.15 | | | | 44.55 | 54.87 | 1.00 |
| Alloy | Ti | Al | Cr | W | Si | B | Cr/W | YS (ksi) | UTS (ksi) | % El. |
| 2 | Bal. | 46.36 | | 2.01 | 0.60 | | 0 | 0.00 | 75.45 | 0.44 |
| 1 | Bal. | 46.43 | | 2.11 | 0.67 | 0.26 | 0 | 83.10 | 88.15 | 0.67 |
| 3 | Bal. | 46.90 | | 2.08 | 0.51 | 0.45 | 0 | 89.50 | 99.65 | 0.83 |
| 4 | Bal. | 46.77 | 1.34 | 1.01 | 0.17 | | 1.33 | 70.60 | 80.30 | 0.92 |
| 5 | Bal. | 46.53 | 1.45 | 0.54 | 0.43 | | 2.68 | 74.40 | 85.10 | 0.89 |
| 6 | Bal. | 46.74 | 1.52 | 0.30 | 0.44 | | 5.07 | 71.70 | 75.30 | 0.62 |
| 7 | Bal. | 46.16 | 1.26 | 0.82 | 0.43 | | 1.54 | 72.00 | 75.80 | 0.60 |
| 8 | Bal. | 46.24 | 1.37 | 0.75 | 0.42 | | 1.82 | 71.80 | 76.30 | 0.70 |
| 12 | Bal. | 45.82 | 1.42 | 0.70 | 0.45 | 0.25 | 2.01 | 80.40 | 92.60 | 1.10 |

| B | As-HIP | As-cast |
|---|---|---|
| 0 | 112.5 | 80.5 |
| 0.45 | 84.3 | 62.5 |

| Cr/W | As-HIP | As-cast |
|---|---|---|
| 0 | 112.5 | 80.5 |
| 1.33 | 99.5 | 65.1 |
| 2.69 | 93.8 | 71.5 |
| 5.07 | 123.2 | 88.6 |

| B | Cr/W=1.9 | Cr/W=0 |
|---|---|---|
| 0 | 76.3 | 75.45 |
| 0.25 | 92.6 | 88.15 |
| 0.45 | | 99.65 |

| B | Cr/W=1.9 | Cr/W=0 |
|---|---|---|
| 0 | 0.7 | 0.44 |
| 0.25 | 1.1 | 0.67 |
| 0.45 | | 0.83 |

| B | Cr/W=1.9 | Cr/W=0 |
|---|---|---|
| 0 | 71.8 | 0 |
| 0.25 | 80.4 | 83.1 |
| 0.45 | | 89.5 |

| Cr/W | B=0 | B=0.25 |
|---|---|---|
| 0 | 75.45 | 88.15 |
| 0 | 88.15 | |
| 1.33 | 80.3 | |
| 2.01 | | 92.6 |
| 2.69 | 85.1 | |
| 5.07 | 75.3 | |

| Cr/W | B=0.25 | B=0 |
|---|---|---|
| 0 | 0.67 | 0.44 |
| 1.33 | | 0.92 |
| 1.82 | | 0.7 |
| 2.01 | 1.1 | |
| 2.69 | | 0.89 |
| 5.07 | | 0.62 |

| Cr/W | B=0.25 | B=0 |
|---|---|---|
| 0 | 83.1 | 0 |
| 1.33 | | 70.60 |
| 1.54 | | 72.00 |
| 1.82 | | 71.80 |
| 2.01 | 80.4 | |
| 2.69 | | 74.40 |
| 5.07 | | 71.70 |

TITANIUM ALUMINIDE ALLOYS CONTAINING BORON, CHROMIUM, SILICON AND TUNGSTEN

CROSS REFERENCE TO RELATED APPLICATIONS

This application claims the benefit under 35 U.S.C.§119 (e) of U.S. Provisional Application No. 60/024,856, filed Aug. 28, 1996.

STATEMENT REGARDING FEDERALLY SPONSORED RESEARCH OR DEVELOPMENT

Some aspects of this invention have been created with the sponsorship or funding of a federally sponsored research or development program, namely, National Aeronautics and Space Administration (N.A.S.A) Small Business Innovation Research (S.B.I.R.) contract no. NAS3-27745.

BACKGROUND OF THE INVENTION

1. Field of the Invention

This invention relates to high temperature alloys for thermal equipment based on intermetallic compounds which are suitable for ordered solidification and to supplement the conventional nickel-based superalloys.

The invention relates to the further development and improvement of the alloys based on an intermetallic compound of the titanium aluminide TiAl type with further additives which increase the strength, the toughness and the ductility.

In the narrower sense, the invention relates to a high temperature alloy for machine components based on doped TiAl.

2. Discussion of Background

Gamma titanium aluminide is an intermetallic compound based on the formula TiAl. Notwithstanding its excellent oxidation resistance, high modulus of elasticity and low density, this intermetallic compound has not seen widespread industrial use in structural applications, due to the relatively low tensile ductility. In general, a minimum of 0.5% elongation is considered marginally acceptable for handling purposes during manufacturing and for actual service conditions.

Intermetallic compounds of titanium with aluminum have some valuable properties which make them appear attractive as structural materials in the medium and higher temperature range. These include, inter alia, their density, which is low compared with superalloys and reaches only about half the value for Ni superalloys. However, their brittleness stands in the way of their industrial applicability in the present form. The former can be improved by additives, in which case higher strength values may also be achieved. Possible intermetallic compounds, some of which have already been introduced, which are known as structural materials are, inter alia, nickel aluminides, nickel silicides and titanium aluminides.

Attempts have already been made to improve the properties of pure TiAl by slight modifications of the Ti/Al atomic ratio and by alloying with other elements. Further elements proposed were, for example, alternatively Cr, B, V, Si, Ta as well as (Ni+Si) and (Ni+Si+B), and also Mn, W, Mo, Nb, Hf. The intention was, on the one hand, to reduce the brittleness, that is to say to increase the ductility and toughness of the material, and, on the other hand, to achieve as high a strength as possible in the temperature range of interest between room temperature and operating temperature. An additional aim was a sufficiently high resistance to oxidation. These aims were, however, only partially achieved.

The high temperature strength of the known aluminides in the meantime still leaves something to be desired. Corresponding to the comparatively low melting point of these materials, the strength, in particular the creep resistance in the upper temperature range, is inadequate, as can also be seen from relevant publications.

U.S. Pat. No. 3,203,794 discloses a TiAl high temperature alloy containing 37% by weight of Al, 1% by weight of Zr and remainder Ti. The comparatively small addition of Zr causes this alloy to have properties comparable to those of pure TiAl.

EP-A1-0,365,598 discloses a high temperature alloy based on TiAl with Si and Nb additives, whereas in EP-A1-0,405,134 a high temperature alloy based on TiAl with Si and Cr additives is proposed.

A series of divisional patents of NAZMY et al., namely U.S. Pat. No. 5,342,577, a division of U.S. Pat. No. 5,286,443, a division of U.S. Pat. No. 5,207,982, discloses three types of doped titanium aluminide alloys. U.S. Pat. No. 5,207,982 focuses on titanium aluminide doped with 0.1–1.5 atom. % Si and 1–8 atom. % W, without B or Cr. U.S. Pat. No. 5,286,443 focuses on titanium aluminide doped with 0.1–1 atom. % B and 1–8 atom. % W and/or Cr, without Si. U.S. Pat. No. 5,342,577 focuses on titanium aluminide doped with 0.1–2 atom. % Ge and 1–4 atom. % W and/or Cr, without B or Si. U.S. Pat. No. 5,207,982 and U.S. Pat. No. 5,286,443 describe various Titanium Aluminide alloys. However, neither patent descibes any alloy combinations of boron and silicon in titanium aluminides modified by chromium and tungsten. It should be noted that the above ranges are calculated from the values recited in the NAZMY claims.

The following documents are also cited in respect of the prior art: N. S. Stoloff, "Ordered alloys-physical metallurgy and structural applications", International Metals Review, Vol. 29, No. 3, 1984, pp. 123–135. G. Sauthoff, "Intermetallische Phasen" ("Intermetallic Phases"), Werkstoffe zwischen Metall und Keramik, Magazin neue Werkstoffe 1/89, p. 15–19. Young-Won Kim, "Intermetallic Alloys based on Gamma Titanium Aluminide", JOM, July 1989, pp. 24–30. This prior art reference has recognized that the mechanical properties (tensile yield strength, ultimate tensile strength, and ductility) of TiAl are affected by deviations from Ti/Al stoichiometric ratio, and small additions of dopants to a non-stoichiometric TiAl composition, even in the range of 0.1 to 1.0 atomic percent. Also relevant is "Ordered Intermetallic Alloys, Part III: Gamma Titanium Aluminides", Young-Won Kim, JOM, July 1994, pp. 30–39.

Often, prior art dopants which are present as ternary additions to a non-stoichiometric TiAl composition impart unpredictable effects on strength or ductility, or both, as taught by U.S. Pat. No. 4,842,820. This patent further teaches that the nature and the concentration of the dopant, as well as the processing (annealing or heat treatment) temperature have a strong bearing on strength and ductility.

Other prior art has shown that, in some instances, although some dopants may produce beneficial effects when added singly, the presence of the same dopants in combination thereof can produce detrimental effects on strength and ductility. For example, U.S. Pat. No. 5,304,344 cites three example alloys, $Ti_{49}Al_{48}V_3$, $Ti_{50}Al_{46}Nb_4$ and $Ti_{48}Al_{48}Ta_4$ (gamma alloy no. 14, 40, and 60 respectively of Table III) which exhibit room temperature ductility greater than 1.0%. However, when the additives vanadium, niobium and tantalum are combined in alloy $Ti_{49}Al_{45}V_2Nb_2Ta_2$, a very low ductility (about 0.1%) results. Clearly, the prior art has conclusively demonstrated the unpredictable response to a combination of dopants that may be beneficial when added as ternary dopants to a non-stoichiometric gamma titanium alloy composition. Those skilled in the art will recognize that the situation is more complex when polynary additives are considered, as is done by the present inventor in this patent application.

It is useful to cite several key patents whose salient features constitute the prior art regarding the beneficial effect of boron as a doping agent in gamma titanium aluminides. Boron has been used to refine the grain size of metallurgical structures, its effectiveness to achieve such refinement being dependent on its concentration and the presence of other dopants in the gamma titanium aluminide composition.

U.S. Pat. No. 4,842,820 teaches the use of boron as a ternary dopant in concentrations varying from 1 to 5 atom. % to effectively achieve high strength and improved ductility.

In U.S. Pat. No. 5,080,860 boron is taught to be in concentrations from 0.5 to 2 atom. % in a gamma titanium aluminide composition containing niobium and chromium. The '860 patent shows chromium has no refining effect on the crystal form of the solidified structure as the aluminum content varies from 46 to 50 atom. %, with the crystal form changing from a large equiaxed structure to a columnar-equiaxed one. Further, the '860 patent prescribes the optimum boron concentration to be between 0.5 and 2 atom. % to achieve a fine grain equiaxed microstructure and property improvements. The same range of boron concentration is specified in U.S. Pat. No. 5,204,058 and U.S. Pat. No. 5,264,054, again for titanium aluminide compositions modified by niobium and chromium. On the other hand, in U.S. Pat. No. 5,205,875 the range of boron concentration varies from 0.1 to 0.2 atom. % for the titanium aluminide alloy $Ti_{Bal.}$—$Al_{46-48}$—$Cr_2$—$Nb_2$—$B_{0.1-0.2}$.

U.S. Pat. No. 5,082,624 and U.S. Pat. No. 5,082,506 relate to doping a niobium containing titanium aluminide with boron additive in concentrations between 0.5 and 2 atom. % in cast, and cast and thermomechanically worked ('506 patent) samples.

The use of boron as a quinary dopant in a titanium aluminide composition modified by chromium and tantalum is taught by U.S. Pat. No. 5,098,653, U.S. Pat. No. 5,131,959, U.S. Pat. No. 5,228,931 and U.S. Pat. No. 5,324,367. The specified ranges of boron concentration (in atom. %) vary as follows: 0.5 to 2 ('653 and '959 patents), 0.1 to 0.3 ('931 patent), and 0.05 to 0.2 ('367 patent).

Other relevant patents are U.S. Pat. No. 4,842,819, U.S. Pat. No. 4,842,820, U.S. Pat. No. 4,857,268, U.S. Pat. No. 4,836,983, and EP-A-0,275,391.

The properties of the known modified intermetallic compounds in general do not yet meet the technical demands for the production of usable workpieces therefrom. This applies in particular with regard to high-temperature strength and ductility. There is therefore a need for further development and improvement of such materials.

These and other difficulties experienced with the prior art alloys and processes have been obviated in a novel manner by the present invention.

It is, therefore, an outstanding object of the present invention to provide a low density alloy which has adequate resistance to oxidation and corrosion at high temperatures and at the same time a high-temperature strength and sufficient toughness in the temperature range of 500 to 1,000 degree(s) C., which alloy is very suitable for ordered solidification and essentially consists of a high melting point intermetallic compound.

It is a further object of the present invention to provide gamma titanium aluminide compositions containing boron, chromium, tungsten and silicon, which are particularly suitable for the manufacture of net-shape components by casting.

Additionally, it is an object of this invention to provide an alloy composition which exhibits adequate room temperature tensile ductility, i.e. minimum 0.5%, to allow handling and finishing of cast components without loss of structural integrity.

Further, it is another object of this invention to provide a gamma titanium aluminide composition which exhibits room temperature tensile strength higher than 75 ksi.

With the foregoing and other objects in view, which will appear as the description proceeds, the invention resides in the combination and arrangement of steps and the details of the composition hereinafter described and claimed, it being understood that changes in the precise embodiment of the invention herein disclosed may be made within the scope of what is claimed without departing from the spirit of the invention.

BRIEF SUMMARY OF THE INVENTION

This invention relates to gamma titanium aluminide compositions containing boron, chromium, silicon and tungsten. The Titanium Aluminum alloy consisting essentially of the formula in atomic percent:

$$Ti_{Bal.}\ Al_{45-48}\ B_{0.01-0.75}\ Cr_{0-2}\ W_{0.25-2.25}\ Si_{0.1-0.7}.$$

The Boron is present in an atom. % of 0.01–0.75. The desired range is 0.1–0.5. The preferred range is 0.25+/−0.05. The optimum range is 0.25.

The Chromium is present in an atom. % of 0–2. The desired range is 1.3–1.6. The preferred range is 1.5+/−0.1. The optimum range is 1.5.

The Tungsten is present in an atom. % of 0.25–2.25. The desired range is 0.3–2.11. The preferred range is 0.75+/−0.05. The optimum range is 0.75.

The Silicon is present in an atom. % of 0.1–0.7. The desired range is 0.4–0.6. The preferred range is 0.5+/−0.05. The optimum range is 0.5.

The atom. % ratio of Cr/W is 0–5. The desired range is 1.33–2.69. The preferred range is 1.8–2.6. The optimum range is 1.85–2.5.

The preferred Titanium Aluminum alloy consists essentially of the formula in atomic percent:

$$Ti_{Bal.}Al_{45.82}B_{0.25}Cr_{1.42}W_{0.70}Si_{0.45}.$$

The invention is also an article and method of forming said article of the above descibed alloy, for use as an engine component in high temperature and high stress situations. The process for forming the product includes investment casting and then thermomechanical treatment and/or homogenization.

This patent application relates to gamma titanium aluminide compositions containing boron, chromium, tungsten and silicon, which are particularly suitable for the manufacture of net-shape components by casting. Additionally, the preferred alloy composition exhibits adequate room temperature tensile ductility, i.e. minimum 0.5%, desireably at least 0.8%, and ideally at least 1.0%, to allow handling and finishing of cast components without loss of structural integrity. Further, the preferred gamma titanium aluminide composition exhibits room temperature tensile strength (R.T. UTS) higher than 75 ksi, desireably at least 85 ksi, and ideally at least 90.0 ksi.

BRIEF DESCRIPTION OF THE DRAWINGS

The character of the invention, however, may best be understood by reference to one of its structural forms, as illustrated by the accompanying drawings, in which:

FIG. 2 is a diagram showing location of measurements,

FIG. 3 is a chart showing target compositions,

FIG. 4 is a chart showing the results of chemical analyses,

FIG. 5 is a chart showing predicted Al content,

FIG. 6 is a chart showing required additions of Al,

FIG. 8 is a chart showing grain size measurements, FIG. 9 is a chart showing micrographs of as-cast and as HIP (Hot Isostatic Pressing) grains, FIG. 10 is a chart showing room temperature tensile test of HIP specimens, FIG. 11 is a chart showing room temperature tensile test of HIP and HT (Heat Treated) specimens, FIG. 12 is a chart showing 1200 degree F. tensile test of HIP and HT specimens, FIG. 13 is a chart showing rejection assumptions, FIG. 14 is a chart showing the effect of production volume on cost per piece, FIG. 15 is a chart showing average values of room temperature tensile properties of various alloys investigated.

DETAILED DESCRIPTION OF THE INVENTION

Figure 1:
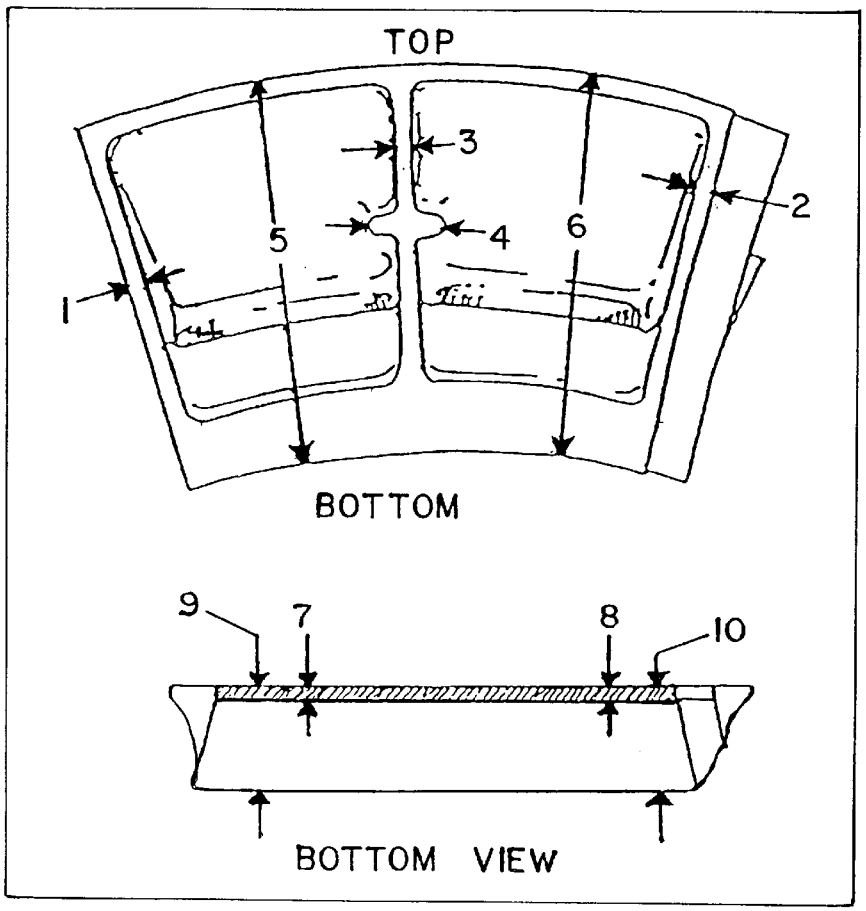
FIG. 1 is a chart showing casting shrink factors.

This invention involves the feasibility of manufacturing net-shape aircraft propulsion components and other engine components from gamma-titanium aluminides.

In one example of the application of this technology, the retaining plate for the first stage high pressure turbine blade was selected as the demonstration component. The retaining plate is a rotating component, mechanically attached to the first stage turbine disk, overlapping the turbine blade root attachment and the disk slot. Its function is to prevent gas leakage. This part is typically made of IN 100, a nickel-base superalloy. However, the lower coefficient of thermal expansion and lower density (half that of nickel-base superalloy) of titanium aluminides are attractive properties that could be exploited for this particular application. The following are the tasks and technical objectives exemplifying this invention.

Task 1—Casting Development: Experimentally demonstrate that the selected turbine blade retaining plate can be manufactured by investment casting.

Task 2—Alloy Modification: Modify the selected titanium aluminide alloy to enhance mechanical properties.

Task 3—Manufacturing Cost Modeling: Develop a manufacturing cost model, based on Technical Cost Modeling methodology, to project the potential manufacturing costs of cast titanium aluminide aerospace components.

The following provides a more detailed narrative of the tasks.

Task 1—Casting Development

Approach: Two iterations were performed to demonstrate the castability of the selected gamma-titanium aluminide alloys. In the first iteration, Ti- 48 Al -2 W- 0.5 Si (in atomic percent), also know as Alloy 2, was used. Alloy 2 exhibits the highest castability amongst known gamma-titanium aluminide alloys. The first casting iteration was employed to define the casting parameters (gating scheme, mold preheat temperature, etc.) for the retaining plate. Having determined the casting parameters for this component, the second casting iteration was used to produce the retaining plate from a modified version of Alloy 2 (see Task 2 below).

Sub-Task 1.1—Procure ingot material

One 5 inch diameter ingot of Alloy 2, weighing about 70 lb., was purchased from The Duriron Company, Inc. The ingot was produced by induction skull melting, using high purity (less than 600 ppm weight percent oxygen) titanium plate, Al shots, Al—W—Ti and Al—Si master alloys. From casting experiments conducted by the present inventor prior to the start of this work, it was found that it is beneficial to employ a 5 inch diameter ingot (rather than a smaller diameter ingot) for economics and processing reasons (see below).

Sub-Task 1.2—Cast retaining plate

The wax pattern tooling for the retaining plate was made available by Pratt & Whitney, Government Engines & Space Propulsion. This retaining plate was designed for the ATTEG common core engine, which has been used to demonstrate propulsion technologies for military aircraft jet engines. Since this tool was manufactured for XD™ castings by Howmet Corporation, using a shrinkage factor different than that of Alloy 2, it is likely that the dimension of the cast titanium aluminide retaining plate will be slightly different from target blueprint dimensions. Also, the tool die has two cavities, one for an oversize component (type A) with additional material stock to aid in filling, and another (type B) with dimensions closer to blueprint. XD™ is a trademark owned by Howmet and refers to a method of casting TiAl with boron to refine grain microstructure.

The 5 inch diameter ingot has been found to be most suited for the current vacuum arc casting furnace, which provides an excellent coupling between the energy input and the rate of metal remelted in the crucible. This coupling produces such a quasi-steady state that the operator hardly has to manually adjust the ingot position during melting, in order to maintain a constant arc length between the electrode tip and the molten metal pool. This is a key factor in achieving a very efficient melting rate and a high process efficiency.

A total of four molds were cast, with each mold containing 24 retaining plates. The alloy used to cast the last mold was Alloy 1, a boron modified version of Alloy 2.

Sub-Task 1.3—Analyze casting results

Visual inspection indicated good filling in all four molds. However, radius shrinkage was more apparent in type B components (mold 3) than a type A components (molds 1 and 2). This can be explained by the fact that Alloy 2 exhibits a different shrink pattern than that of XD™ (with the latter being used to design the current tooling). Radius shrinkage was less prevalent in both types of components cast from mold 4. The reason for this behavior could be attributed mainly to a change in gating design. Representative samples of each type were subsequently inspected by X-ray radiography and by liquid penetrant. X-ray inspection showed internal gas porosity that could be closed by HIP. Liquid penetrant confirmed the radius shrinkage to occur mostly at the center rib section.

Dimensional measurements were made on representative type A and type B components at locations indicated in FIG. 2 to obtain the shrink factors for Alloy 2. FIG. 1 provides results of the shrink factor measurements. In general, it appears that the shrink factors determined by performing measurements on the thicker sections (type A components) are greater than those obtained from the thinner ones. However, considering the respective standard deviations associated with each set of measurements, it is reasonable to attribute an overall shrink factor for each step of the manufacturing process.

Task 2—Alloy Modification

Approach: In this task the composition of Alloy 2 was modified to achieve enhanced mechanical properties, such as room temperature ductility. Although Alloy 2 has been found suitable for land-based applications, its low room temperature ductility (about 0.6%) is cause for concern in regards to aerospace applications. Also, because of the necessity to increase mold preheat temperature to fill thin sections of a component, the resulting grain size tends to be larger than that obtained at a lower mold preheat temperature. Thus, the need arises to modify the composition of Alloy 2 to achieve grain refinement and improved ductility.

Sub-task 2.1—Select alloy compositions

The rationale used in the selection of the modifications to Alloy 2 is given in the following discussion. Observations on cast XD™ gamma-titanium aluminide components indicate the grain size is generally smaller than that of monolithic gamma-titanium aluminides. Thus, it is may be equally possible to achieve the desired grain refinement in monolithic gamma-titanium aluminides by boron addition without degrading alloy castability.

Sobojeyo et al. (W. O. Sobojeyo and C. Mercer, *The Effects of Alloying and Microstructure on the Fracture of Intermetallic Compounds Based on TiAl,* Symposium on Fatigue and Fracture of Ordered Intermetallics, TMS, Warrendale, Pa., 1993; C. Mercer and W. O. Sobojeyo, *Effects of Alloying on Crack Tip Deformation and Shielding in Gamma-Based Titanium Aluminides,* International Symposium on Gamma Titanium Aluminides, TMS Annual Meeting, Las Vegas, 13–16 Feb., 1995.) have proposed a micro-mechanical model to explain the effects of alloying the Mn, V and Cr on monotonic and cyclic properties. The model, which is based on non-linear fracture mechanics, takes into account the contribution of twin toughening to crack tip shielding. Twin toughening refers to a mechanism by which a twin process zone around a crack leads to a re-distribution of stresses over this zone which may cause a beneficial crack tip shielding effect in the form of a reduced stresses intensity at the crack tip. Of the three alloying additions studied, Cr is the most effective element, followed by V and Mn. For this reason Cr is used to modify the composition of Alloy 2.

FIG. 3 shows the 5 alloy modifications to Alloy 2. Alloy 1 and Alloy 3 are modifications of Alloy 2 in which boron was added at two different levels in an attempt to decrease grain size. Alloys 4 through 6 are modifications of Alloy 2 in which chromium was added at 1.5 at %, while varying Cr/W ratio at 1.5, 3.0, and 7.5 respectively. In this alloy series, the ductilization effect of Cr was evaluated in an effort to increase room temperature ductility. From experimental evidence in other alloy development programs, the most expedient way to assess the potential combined effects of two elements is to use a modified geometric progression. Here the initial $a_1$=Cr/W for Alloy 4 has been chosen as 1.5 as a compromise between strength and ductility. Subsequent Cr/W ratios are determined by use of the relationship $a_n=a_1 2^{n-1}+a_1$ with n being 2 for Alloy 5 and 3 for Alloy 6.

Sub-task 2.2—Prepare and cast test bars

One 5 inch diameter ingot with a nominal 70 lb. weight was melted for each of the 6 compositions shown in FIG. 3. The Duriron Company, Inc. produced the six ingots by induction skull melting in the fashion reported in Sub-task 1.1—Procure ingot material. Portions of each ingot were remelted for pouring into ceramic shell molds containing 20 cast-to-size tensile test specimens, with a nominal 0.130 inch gage diameter.

A mold of tensile specimens was cast from Alloy 2, yielding 10 specimens out of 20. This low casting yield (50%) stems from the fact that each test specimen cavity is fed one gate at each end to ensure fill. Because the gates are slightly oversized compared to the gage diameter, there is a tendency for specimen breakage during mold cool down due to solidification stresses arising from the constraints.

To remedy this situation, and thus increase the casting yield, the gates were made smaller and square in cross section (instead of a circular cross section) at their junctions with the runners to induce potential breakage at these locations, thereby suppressing tensile loading in the gage area. Implementation of these changes resulted in a higher casting yield for the remaining molds of test specimens.

Sub-task 2.3—Characterize and test

Chemical analyses: FIG. 4 provides results of the chemical analyses performed by Sherry Laboratories.

The target Al content was selected to be 47.45 atomic percent (atom. %) based on past experience with Alloy 2. By aiming for 47.45 atom. % Al in the ingot material, the analyzed Al content in the casting will fall within the specification range. The analyzed Al contents shown in FIG. 4 indicate this has been achieved for the six alloy compositions. The only deviation from the aim chemistries is the lower Si content in Alloy 4 (0.17 atom. % actual vs. 0.50 atom. % aimed). A review of the material input weights for each heat shows that the correct amount of Si was weighed and added to the melt at Duriron. The reason for this discrepancy is not known at this time.

Figure 7:
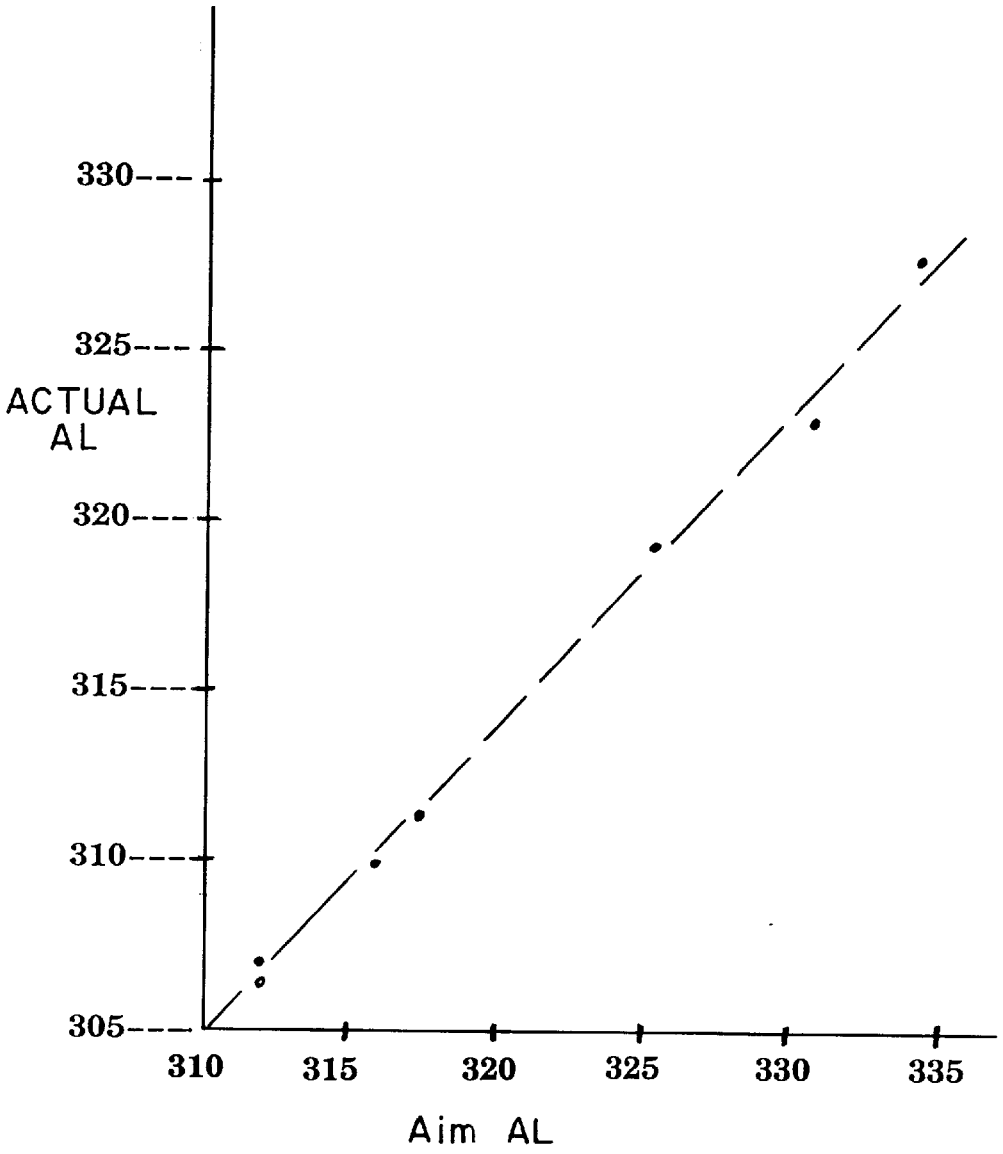
FIG. 7 is a chart showing the correlation between Al (ingot) and Al (casting)

Since the range of Al in the alloy compositions varies from 30.69 to 32.75 wt. %, it is instructive to correlate the Al input contents in the ingots to the analyzed Al contents in the castings, to account for Al losses due to evaporation during vacuum arc remelting. FIG. 7 shows a straight line correlation described by the following equation:

$$\text{Al(wt. \%)}_{casting}=0.9\ \text{Al (wt. \%)}_{ingot}+2.6$$

Use of this predictive relationship as a process control for the ingot target chemistry will lead to results shown in FIG. 5. The discrepancy between the predicted and actual values for the Al content in the castings falls well within the measurements scatter for Al (+/−0.4 wt. %). Thus to achieve the target Al contents in the castings it is required to add from 0.58 to 0.82 wt. % to the target values of Al content to account for evaporation losses (see FIG. 6).

Microstructural analyses: After casting, the test specimens were given the following thermal processing: hot isostatic pressing (HIP) at 2125° F./25 ksi/4 hours, followed by a heat treatment (HT) at 2015° F./20 hours under partial pressure of argon.

The six alloys exhibit a lamellar microstructure in the as-cast (FIG. 9, left view) and as-HIP conditions (FIG. 9, right view). The selected heat treatment preserves the lamellar microstructure. Grain size measurements were performed for each alloy at the three conditions. The results shown in FIG. 8 indicate that additions of B to Alloy 1 and Alloy 3 effectively retard grain growth in the HIP and HIP+HT conditions. In the HIP+HT condition the Cr bearing alloys appear to exhibit higher grain growth than the baseline alloy.

Tensile testing: Tensile testing was conducted at room temperature on HIP and HIP+HT tensile specimens, and at 1200° F. on HIP+HT specimens. Initial tests resulted in failure occurring outside the gage length. Machining the gage diameter from 0.130 in. to 0.100 in. eliminated this problem. The tensile test results shown in FIGS. 10, 11, and 12 were obtained from tests on 0.100 inch diameter samples.

Analysis of the tensile test results provides the following conclusions:

Additions of boron increases tensile strength and ductility by refining the grain size, as evidenced by the tensile behavior of Alloy 3.

Addition of chromium enhances room temperature tensile ductility, with a tradeoff in strength. Alloy 5 exhibits the best combination of tensile strength and ductility, suggesting the optimum Cr/W ratio for the Cr bearing alloy modifications to be about 2.5.

Furthermore, Alloy 3 and Alloy 5 exhibit tensile strengths superior to all current cast gamma-titanium aluminides (Young-Won Kim, "Ordered Intermetallic Alloys, Part III: Gamma Titanium Aluminides", JOM (July 1994): 30–39). These results are even more significant in light of the fact that they were obtained from a refined fully lamellar microstructure referred to by Kim. The tensile properties exhibited by the HIP specimens suggest that the refined fully lamellar microstructure can be obtained by a stabilization heat treatment. Such heat treatment must be conducted at temperatures lower than 2015° F., because heat treatment at or above that temperature was shown in this investigation to have a deleterious impact on room temperature tensile ductility (see FIG. 10 versus FIG. 11).

Task 3—Manufacturing Cost Modeling

Approach: In this task the expertise of IBIS Associates was used to simulate the impact of manufacturing costs, concentrating on areas that will lower costs. Developed by IBIS, Technical Cost Modeling (TCM) is a powerful tool for analyzing the economics of alternative materials and processes (J. Busch, "Cost Modeling as a Technical Management Tool", Research-Technology Management (Nov–Dec 1994): 50–56). The technique is an extension of conventional process modeling, with particular emphasis on capturing the cost implications of material and process variables and changing economic scenarios. The key strength of this tool lies in its ability to link together TCMs from different process steps, providing an extensive cost simulation.

The Technical Cost Model (TCM), developed by IBIS to simulate the manufacturing cost of the turbine blade retaining plate includes the following processing steps.

(1) Wax patterns molding
(2) Slurry dip and drying
(3) Autoclave dewax & shell firing
(4) Melting & pouring
(5) Mold cleaning
(6) Visual Inspection
(7) HIP
(8) Heat treat
(9) X-ray radiography
(10) Penetrant inspection
(11) Dimensional inspection
(12) Chemical milling
(13) Finishing The model includes information on cycle time, materials, direct labor and energy costs for each processing step. The model helps identify critical cost drives and determine the sensitivity of the total manufacturing cost to these variables. In addition, the model also determines the value of carrying out certain processes in-house rather than outsourcing them.

The following provides the salient results derived from the model, with the "piece cost" referring to the direct manufacturing cost of the retaining plate. To demonstrate the powerful usefulness of the model, the following discussion employs the assumptions shown in FIG. 13.

The rejection rate assumed for the visual inspection step is reasonable in light of the results obtained in Task 1. With the rejection rate for each of the processing steps not shown in the above table being equal to 0%, the overall manufacturing (or cumulative) yield is 73.7%.

FIG. 14 presents the effect of production volume on manufacturing cost. It can be seen that by increasing the annual production volume from 10,000 to 100,00 pieces, the manufacturing cost per piece decreases from $19.93 to $18.60, for a cost reduction of 6.7%. The same figure indicates there is limited sensitivity of piece cost to further increase in annual production volume. This behavior can be explained by looking at the cost breakdown by operations, or by elements.

An examination of the data indicates subcontracting costs, and specifically X-ray inspection, contribute heavily to manufacturing cost.

Thus, despite the added economy of scale associated with a larger production run, the cost of subcontracting X-ray inspection is a major impediment to cost reduction. On the other hand, if this capability is brought in-house an added potential decrease of $4.25 per piece cost can be realized, resulting in a $14.35 in manufacturing piece cost. In this instance, the potential cost reduction is 28% as annual production increases by an order of magnitude. To achieve this production volume requires added investment in capital equipment of the order of 6%.

CONCLUSIONS

This investigation demonstrates that the turbine blade retaining plate can be manufactured by near net-shape investment casting at a reasonable cost. Cost modeling has assessed key cost drivers that can be used to significantly reduce manufacturing costs. Finally, modifications to the selected alloy show promises of achieving a more balanced set of tensile properties. Further investigation should include an optimization of alloy chemistry to achieve a balance of tensile, creep and fracture toughness properties.

From the foregoing, it will be seen that a family of cast titanium aluminum alloys containing boron, chromium, silicon, and tungsten have been described. More specifically, included is a TiAl composition based on the approximate formula:

$$Ti_{Bal.}Al_{45\text{-}48}—B_{0.01\text{-}0.75}—Cr_{0.2}—W_{0.25\text{-}2.25}—Si_{0.1\text{-}0.7}$$

A preferred composition based on the above approximate formula contains 0.25 atom. % boron. A preferred composition based on the above approximate formula contains an atomic % (Cr/W)=2. The invention includes a structural article cast from the approximate formula, then homogenized. The invention further includes a structural article cast from the approximate formula, then processed by thermomechanical treatment.

Figure 16:
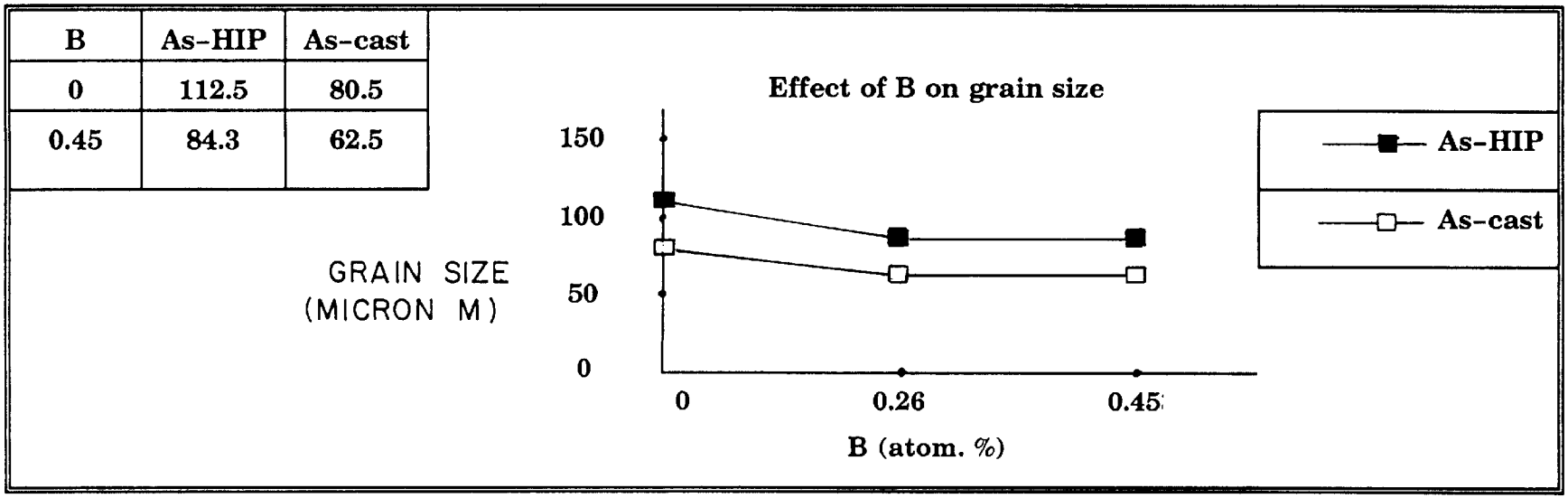
FIG. 16 is a chart showing the effect of B on grain size.
Figure 17:
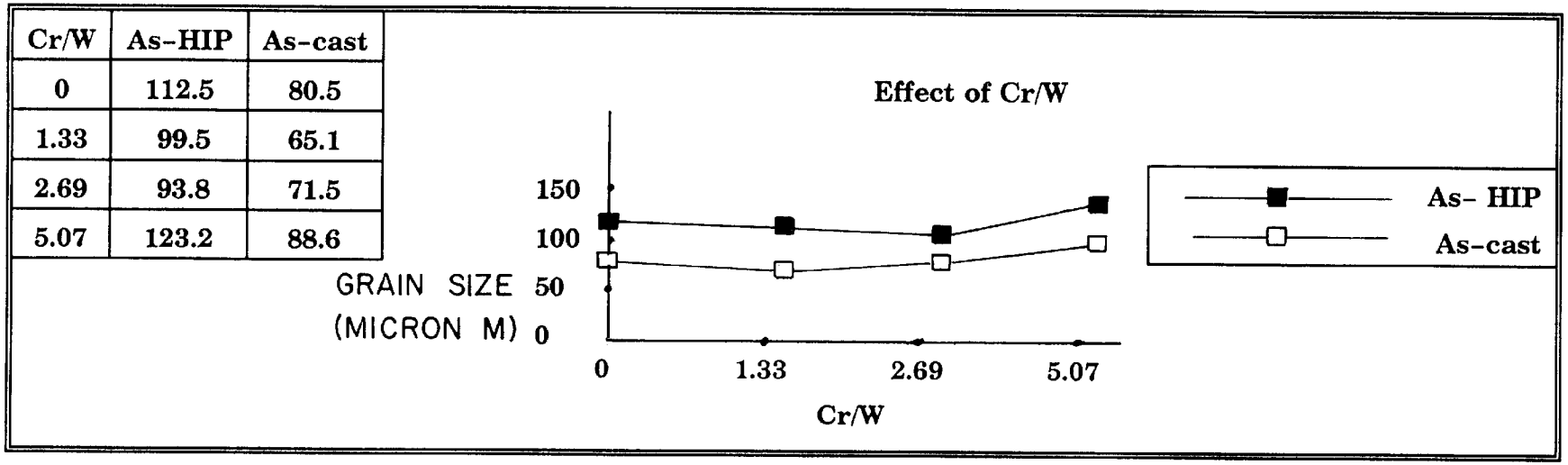
FIG. 17 is a chart showing the effect of Cr/W on grain size.

The following figures further summarize this information. FIG. 15 shows data for the original (Phase 1) Alloys 1–6 and for additional alloys 7, 8, 11, and 12. FIG. 16 uses data from FIG. 8 to show the beneficial effect of boron in reducing the grain size. Specifically, a small grain size is beneficial for castability and tensile strength. Furthermore, as shown in FIG. 17, grain size reaches a minimum at Cr/W atomic % ratio of about 2 to 2.5. This result is different from other references. For example, U.S. Pat. No. 5,204,058 (GE) teaches that modifying gamma titanium aluminides with chromium does not change the crystal form of the solidified structure (see Table II of the GE patent). Likewise, the ABB compositions (described in U.S. Pat. Nos. 5,207,982, 5,286,443, and 5,342,577) modified by silicon and tungsten, do not combine the added effect of chromium.

Figure 18:
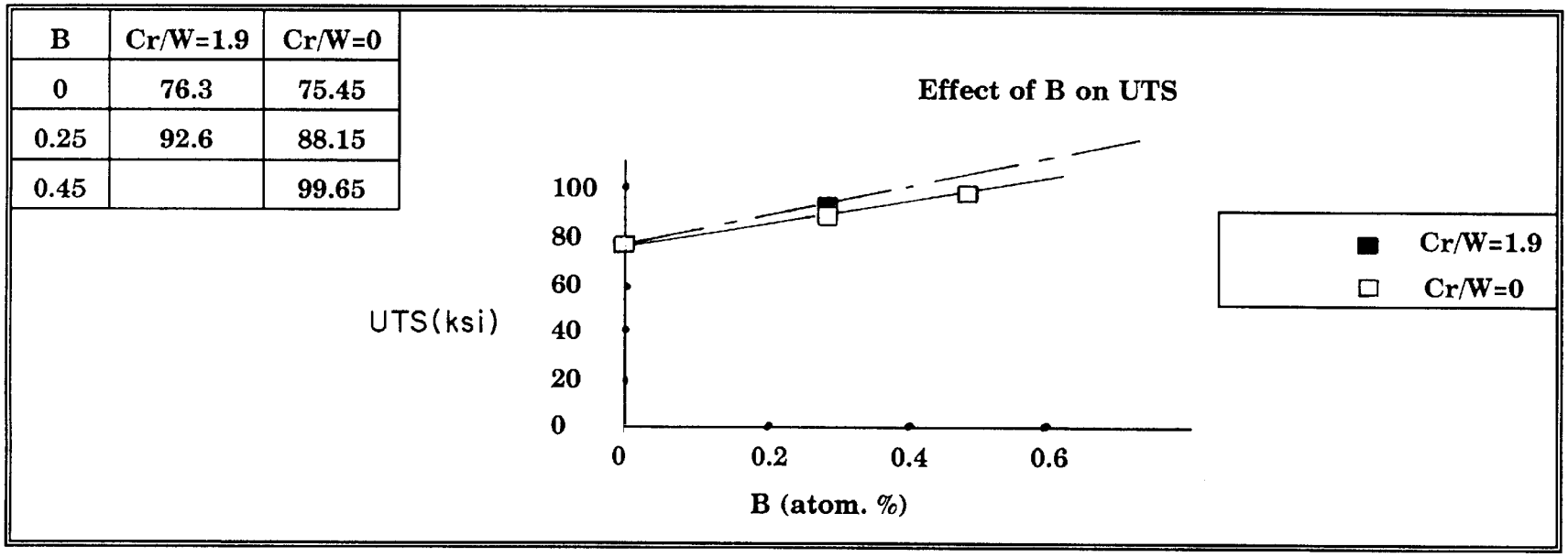
FIG. 18 is a chart showing the effect of B on UTS (Ultimate Tensile Strength)
Figure 19:
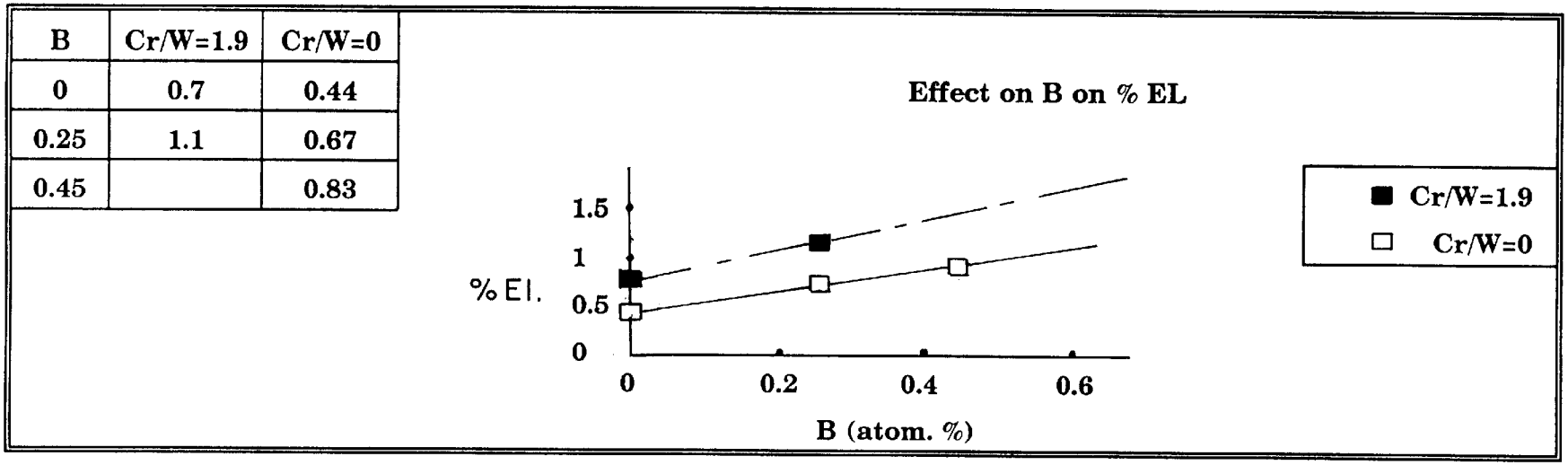
FIG. 19 is a chart showing the effect of B on % El (Percent Elongation)

Turning now to FIGS. 18 and 19, showing data taken from FIG. 15, these figures show the additive effect of boron on ultimate tensile strength (UTS) and ductility (%EI). Within the range of boron examined (up to 0.5 atom. %), it is possible to ascribe the following increase in UTS and ductility as a linear function of boron addition;

$$\Delta(\mathrm{UTS})_{ksi} = 51.3 \times B_{atom\ \%}$$

$$\Delta(\mathrm{ductility})_{\%EL} = 0.87 \times B_{atom\ \%}$$

Figure 21:
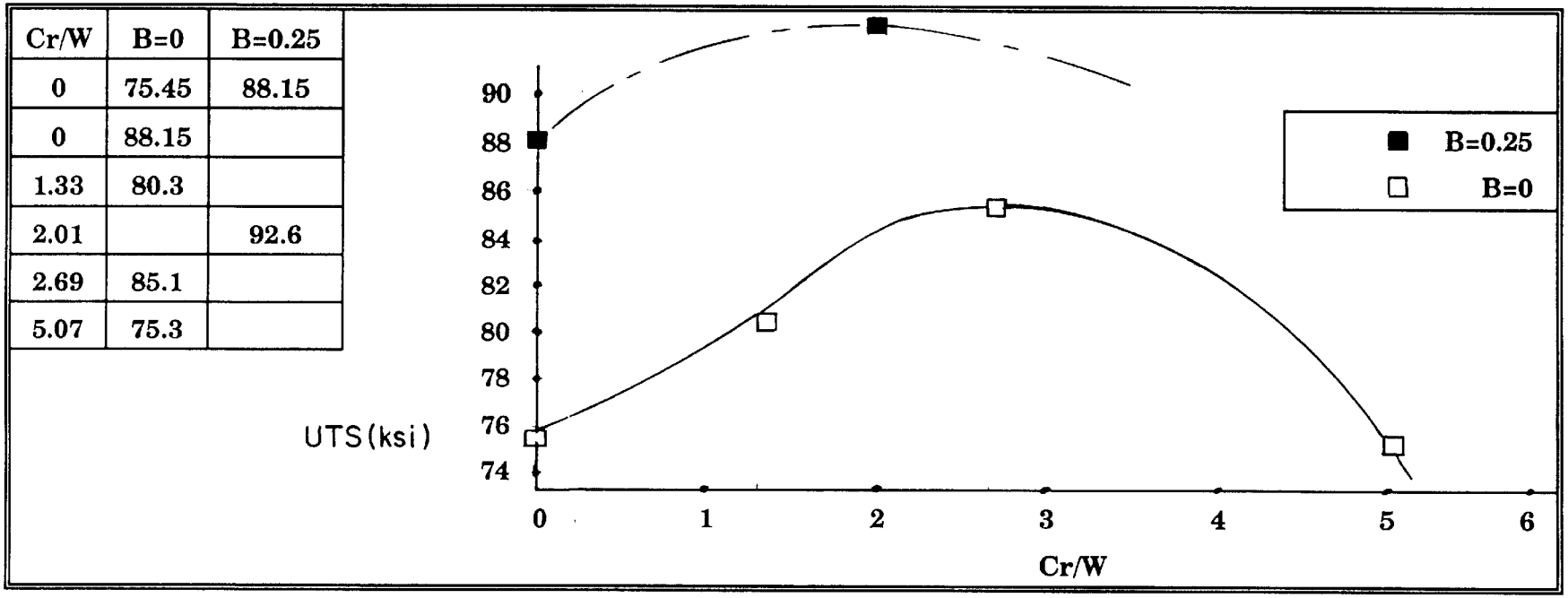
FIG. 21 is a chart showing the effect of Cr/W on UTS.
Figure 22:
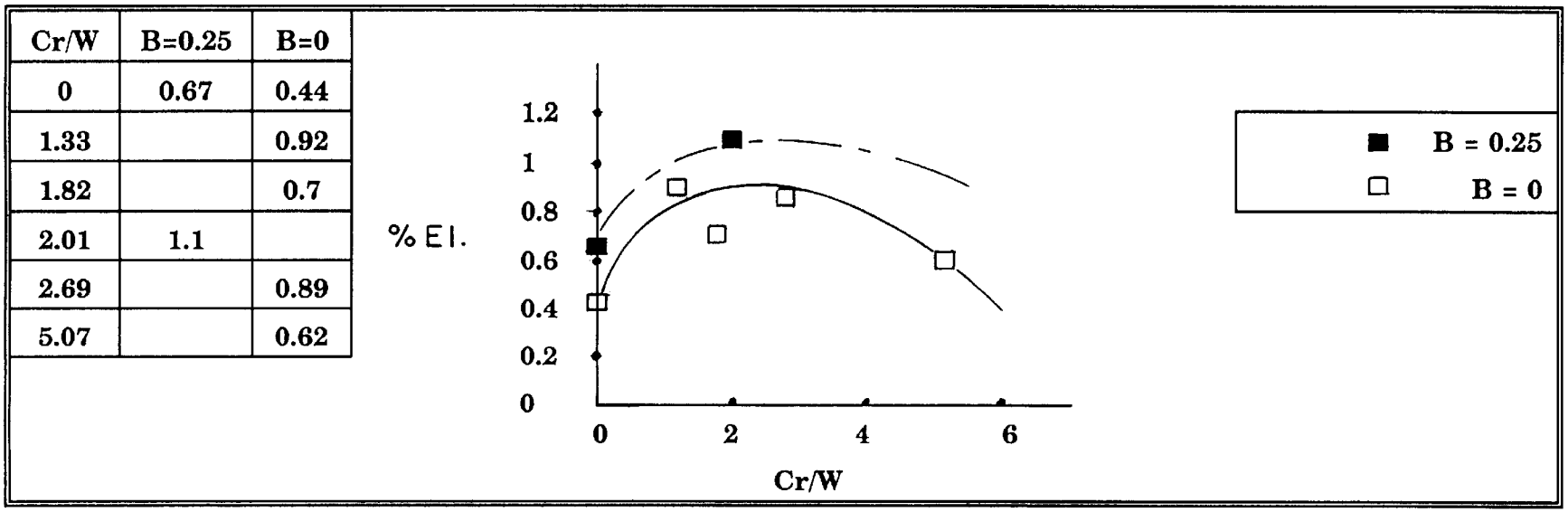
FIG. 22 is a chart showing the effect of Cr/W on % El.

FIGS. 21 and 22, with data taken from FIG. 15, show that UTS and ductility reach a maximum at different Cr/W ratio: about 2.5 for UTS and about 2.0 for ductility. However, at Cr/W=2 and adding 0.25 atom % boron, the above formulae will yield the following results:

$$\mathrm{UTS}_{ksi} = 84 \text{ (from FIG. 14)} + (51.3 \times 0.25) = 96.8 \text{ ksi}$$

$$\text{Ductility} = 0.95 \text{ (from FIG. 15)} + (0.87 \times 0.25) = 1.2\% \text{ elongation}$$

Figure 20:
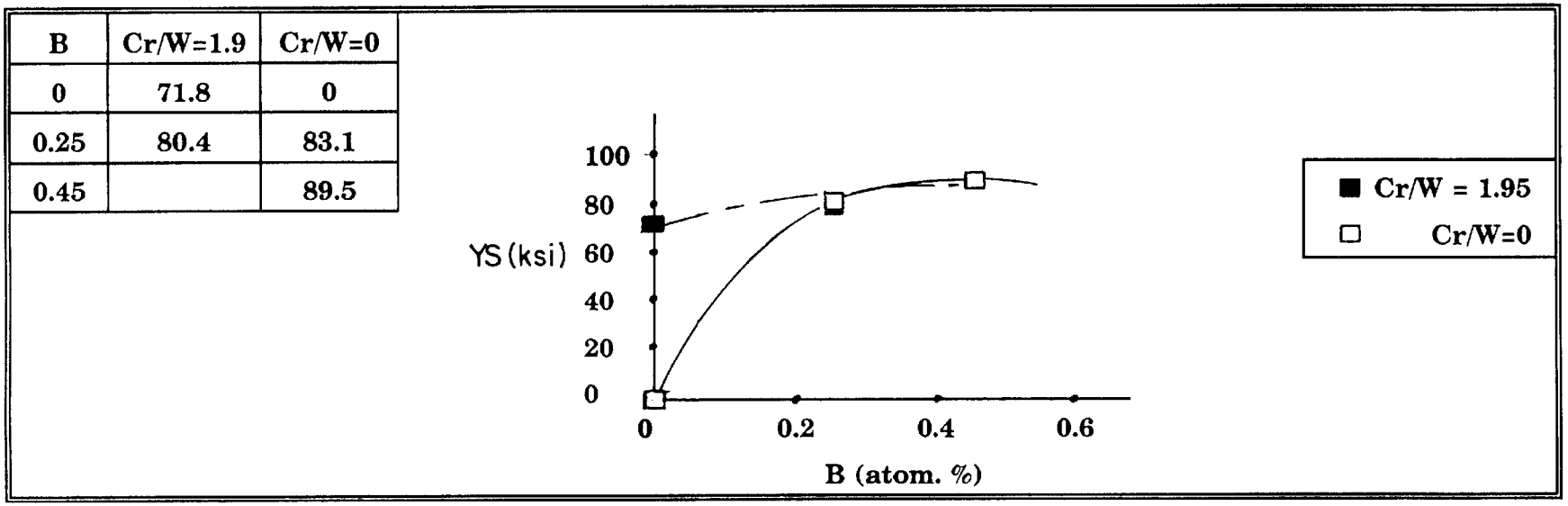
FIG. 20 is a chart showing the effect of B on YS (Yield Strength)
Figure 23:
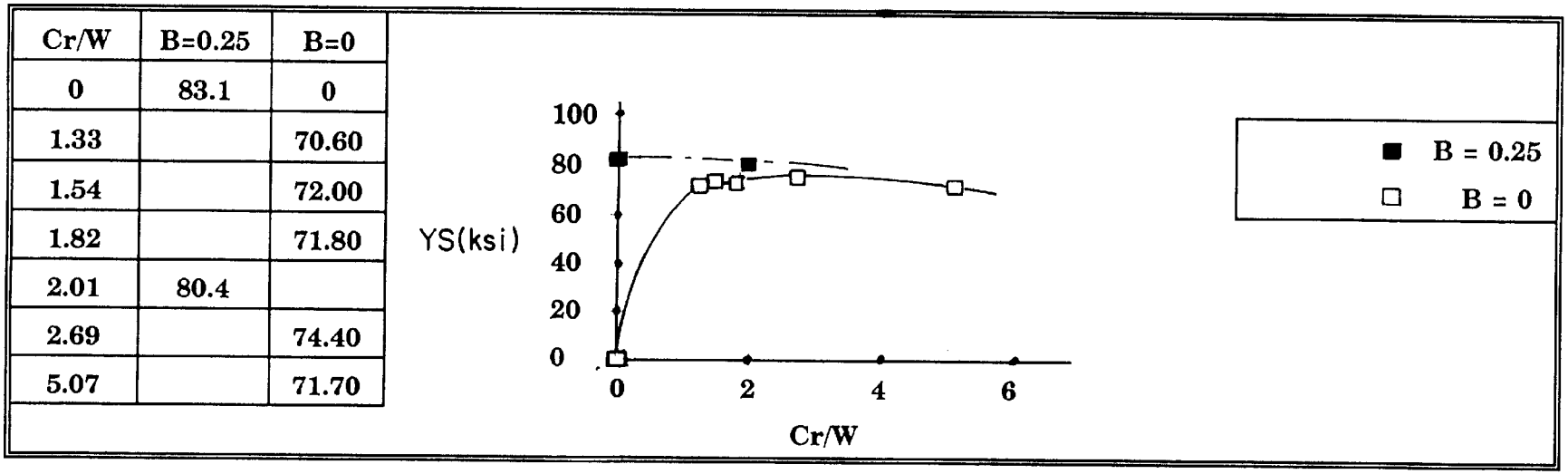
FIG. 23 is a chart showing the effect of Cr/W on YS.
Figure 7:
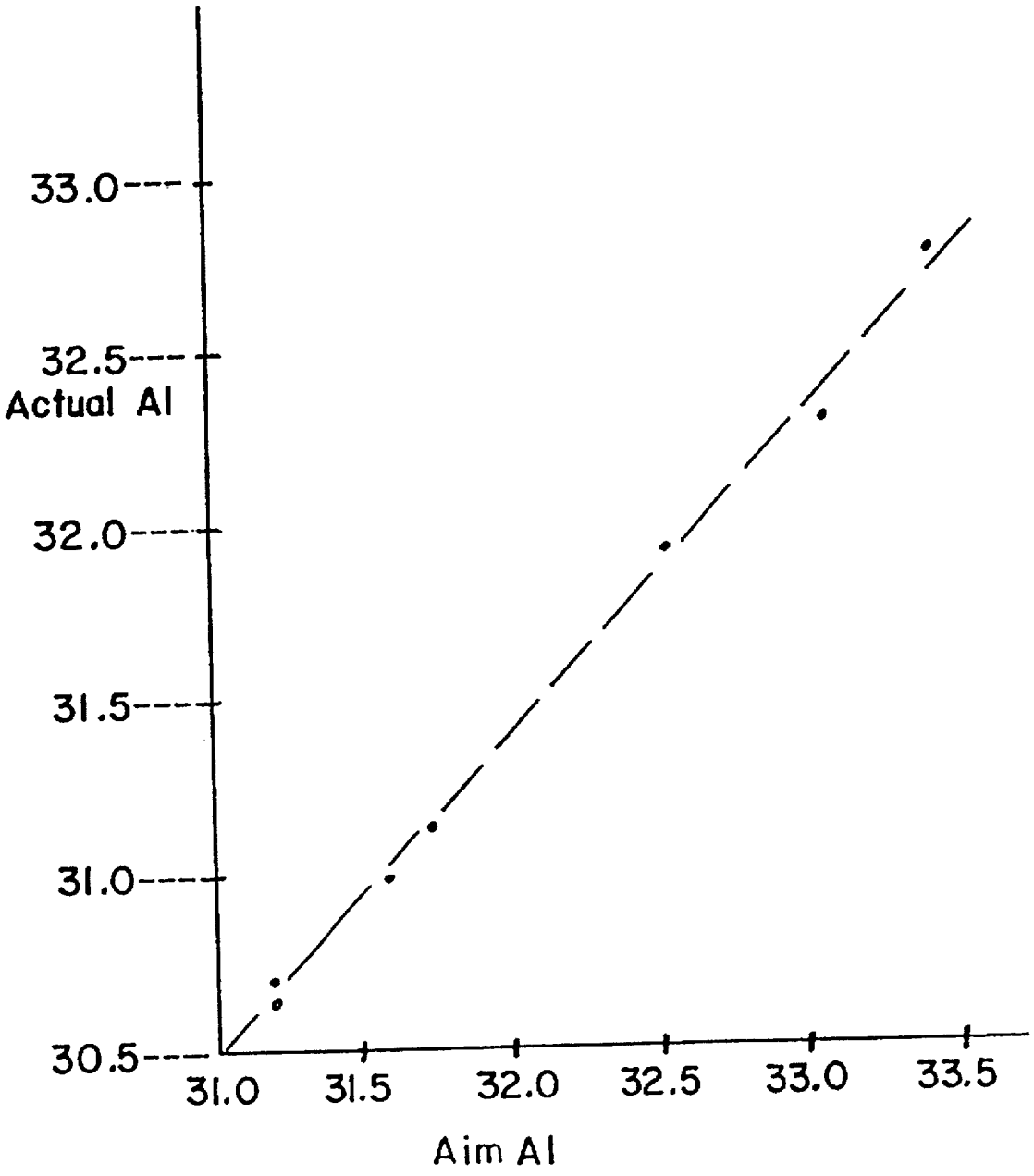

FIGS. 20 and 23 show yield strength, with data taken from FIG. 15.

Thus, a small addition of boron can have additive effect on room temperature strength and ductility, whereas a large addition of boron may have a deleterious effect (decrease) on ductility.

The following examples further explore the implications of the data.

Example 1: Using Alloy 11 and Alloy 2 to illustrate the dichotomy of strength and ductility.

Alloy 11 is from U.S. Pat. No. 4,294,615. It illustrates the point that a ductility of 1% is accompanied by lower tensile strength (below 60 ksi). Alloy 2 is from U.S. Pat. No. 5,207,982. It illustrates the point that higher tensile strength (above 70 ksi) is accompanied by low ductility (below 0.5%). Note that Alloy 2 does not exhibit any yield strength.

Example 2: Using Alloy 2, 1, and 3 to illustrate the beneficial effect of boron on:

a) decreasing the grain size (FIG. 16);
b) increasing the tensile strength (FIG. 18);
c) increasing the ductility (FIG. 19);
d) providing for the yield strength (even when Cr/W ratio=0) (FIG. 20).

Example 3: Using Alloy 2, 4, 5 and 6 to illustrate the effects of Cr/W ratio on:

a) grain size, with optimum Cr/W between 1.3 and 2.7 (FIG. 17);
b) tensile strength (FIG. 21) , with optimum Cr/W between 2 and 4 at B=0;
c) ductility (FIG. 22), with optimum Cr/W between 2 and 3 at B=0;
d) yield strength relatively constant (FIG. 23) for Cr/W between 2 and 4 at B=0.

Example 4: Using Alloy 7, 8 and 12 to clarify the effects of the dopants on properties.

Alloys 7 and 8 add more data to the previous series of alloys in Example 3, with the exception that the Cr/W ratio for Alloy 8 is 1.82.

Alloy 12 provides the preferred composition at B=0.25 atom %. Note the high strength and a ductility of 1.1%. Further, the room temperature tensile properties are within 8% of the predictive values provided by previous equations. This approach to alloy optimization is unique and therefore different from the prior art. In FIG. 18, FIG. 19, and FIG. 20, the data for Alloy 8 and Alloy 12 are presented as if the Cr/W=1.9, which is the average value for 1.82 and 2.01.

While it will be apparent that the illustrated embodiments of the invention herein disclosed are calculated adequately to fulfill the object and advantages primarily stated, it is to be understood that the invention is susceptible to variation, modification, and change within the spirit and scope of the subjoined claims.

What is claimed is:

1. A titanium aluminum alloy consisting essentially of the formula in atomic percent:

$$Ti_{Bal.}Al_{45\text{-}48}B_{0.01\text{-}0.75}Cr_{0\text{-}2}W_{0.25\text{-}2.25}Si_{0.1\text{-}0.7}.$$

2. An alloy as recited in claim 1, wherein B is present as atom. % 0.1–0.5.

3. An alloy as recited in claim 1, wherein B is present as atom. % 0.25+/−0.05.

4. An alloy as recited in claim 1, wherein B is present as atom. % 0.25.

5. An alloy as recited in claim 1, wherein Cr is present as atom. % 1.3–1.6.

6. An alloy as recited in claim 1, wherein Cr is present as atom. % 1.5+/−0.1.

7. An alloy as recited in claim 1, wherein Cr is present as atom. % 1.5.

8. An alloy as recited in claim 1, wherein W is present as atom. % 0.3–2.11.

9. An alloy as recited in claim 1, wherein W is present as atom.% 0.75+/−0.05.

10. An alloy as recited in claim 1, wherein W is present as atom. % 0.75.

11. An alloy as recited in claim 1, wherein Si is present as atom. % 0.4–0.6.

12. An alloy as recited in claim 1, wherein Si is present as atom. % 0.5+/−0.05.

13. An alloy as recited in claim 1, wherein Si is present as atom. % 0.5.

14. An alloy as recited in claim 1, wherein the atom. % ratio of Cr/W is 0–5.

15. An alloy as recited in claim 1, wherein the atom. % ratio of Cr/W is 1.33–2.69.

16. An alloy as recited in claim 1, wherein the atom. % ratio of Cr/W is 1.8–2.6.

17. An alloy as recited in claim 1, wherein the atom. % ratio of Cr/W is 1.85–2.5.

18. A titanium aluminum alloy consisting essentially of the formula in atomic percent:

$$Ti_{Bal.}Al_{45.82}B_{0.25}Cr_{1.42}W_{0.70}Si_{0.45}.$$

19. A process for forming a product of titanium aluminum alloy consisting essentially of the formula in atomic percent:

$Ti_{Bal.}Al_{45-48}B_{0.01-0.75}Cr_{0-2}W_{0.25-2.25}Si_{0.1-0.7}$ the process including casting and then thermomechanical treatment.

20. A process for forming a product of titanium aluminum alloy consisting essentially of the formula in atomic percent: the process including casting and then homogenization.

* * * * *

UNITED STATES PATENT AND TRADEMARK OFFICE

CERTIFICATE OF CORRECTION

PATENT NO. : 5,908,516
DATED : June 1, 1999
INVENTOR(S) : Xuan Nguyen-Dinh

It is certified that error appears in the above-identified patent and that said Letters Patent is hereby corrected as shown below:

The Drawings sheet, consisting of Fig. 7, should be deleted to be replaced with the Drawing sheet, consisting of Fig. 7, as shown on attached page.

FIG. 7
Correlation between aim Al content (ingot) and actual Al content (casting).

Signed and Sealed this

Thirty first Day of July, 2001

Nicholas P. Godici

*Attest:*

*Attesting Officer*

NICHOLAS P. GODICI
*Acting Director of the United States Patent and Trademark Office*

Correlation between aim Al content (ingot) and actual Al content (casting).